US006012438A

United States Patent [19]

Joos et al.

[11] Patent Number: 6,012,438

[45] Date of Patent: Jan. 11, 2000

[54] SYSTEM FOR CHECKING A PRESSURE SENSOR OF A FUEL SUPPLY SYSTEM FOR AN INTERNAL COMBUSTION ENGINE

[75] Inventors: Klaus Joos, Walheim; Hansjoerg Bochum, Leinfelden, both of Germany

[73] Assignee: Robert Bosch GmbH, Stuggart, Germany

[21] Appl. No.: 09/081,295

[22] Filed: May 20, 1998

[30] Foreign Application Priority Data

May 21, 1997 [DE] Germany ..... 197 21 176

[51] Int. Cl.[7] ..... F02D 41/22

[52] U.S. Cl. ..... 123/690; 123/479; 123/198 D; 73/118.1; 73/119 A

[58] Field of Search ..... 123/690, 456, 123/479, 198 D; 73/118.1, 117.2, 119 A

[56] References Cited

U.S. PATENT DOCUMENTS

| | | | |
|---|---|---|---|
| 5,094,214 | 3/1992 | Kotzan | 123/690 |
| 5,168,854 | 12/1992 | Hashimoto et al. | 123/690 |
| 5,241,933 | 9/1993 | Morikawa | 123/198 D |
| 5,493,902 | 2/1996 | Glidewell et al. | 123/479 |
| 5,706,793 | 1/1998 | Orzel et al. | 123/690 |
| 5,783,990 | 7/1998 | Dambach | 123/690 |

FOREIGN PATENT DOCUMENTS 195 48 279 4/1997 Germany .

*Primary Examiner*—Tony M. Argenbright
*Assistant Examiner*—Arnold Castro
*Attorney, Agent, or Firm*—Walter Ottesen

[57] ABSTRACT

The invention is directed to a method of checking a pressure sensor of a fuel supply system of an internal combustion engine such as an engine for a motor vehicle. The fuel supply system includes a pressure store to which fuel is supplied and a pressure sensor for measuring the pressure in the pressure store. Fuel is supplied from the pressure store to a combustion in the engine and the pressure in the pressure store is changed. The behavior of the combustion of the fuel is detected and a conclusion is drawn as to the operability of the pressure sensor from the detected behavior of the combustion.

21 Claims, 3 Drawing Sheets

SYSTEM FOR CHECKING A PRESSURE SENSOR OF A FUEL SUPPLY SYSTEM FOR AN INTERNAL COMBUSTION ENGINE

FIELD OF THE INVENTION

The invention relates to a method for checking a pressure sensor of a fuel supply system for an internal combustion engine such as for a motor vehicle. In this method, fuel is supplied to a pressure store and the pressure in the pressure store is measured by a pressure sensor and the fuel is supplied from the pressure store to a combustion. The invention also relates to a fuel supply system for an internal combustion engine such as an engine of a motor vehicle equipped with a pressure store. A pressure sensor and a pressure valve are assigned to the pressure store. The engine further includes a pump with which fuel is supplied to the pressure store and the engine has a control apparatus for controlling the variables which influence the combustion of the fuel. The control apparatus can open-loop control and/or closed-loop control these variables.

BACKGROUND OF THE INVENTION

Ever higher requirements are imposed on an internal combustion engine, such as an engine of a motor vehicle, with a view to reducing the consumption of fuel and the generated exhaust gas while, at the same time, providing increased power. To satisfy these requirements, it is necessary that all components of the engine operate with continued precision and that even slight changes and defects are detected early and reliably.

Modern internal combustion engines are provided with a fuel supply system wherein the supply of fuel into the combustion chamber of the engine is carried out electrically and especially with a computer-supported control apparatus. It is possible to inject the fuel into an air intake manifold of the fuel supply system or directly into the combustion chamber of the engine. In the last-mentioned type, it is necessary that the fuel be injected into the combustion chamber under pressure. For this purpose, a pressure store is provided into which the fuel is supplied by means of a pump and is placed under pressure. From the pressure store, the fuel is then injected via injection valves into the combustion chambers of the engine.

For a precise control (open-loop and/or closed-loop) of the injected fuel quantity, the pressure store is provided with a pressure sensor with which the pressure in the pressure store is measured. The pressure valve and/or the pump are so controlled (open-loop and/or closed-loop) in dependence upon the measured pressure that a desired pressure is provided in the pressure store. An imprecise measurement of the pressure by the pressure sensor or even a defect of the pressure sensor can have as a result that the desired pressure cannot be provided and therefore the initially-mentioned requirements of the engine can no longer be satisfied.

SUMMARY OF THE INVENTION

In view of the above, it is an object of the invention to provide a fuel supply system which detects an inaccuracy or a defect of the pressure sensor.

The method of the invention is for checking a pressure sensor of a fuel supply system of an internal combustion engine such as an engine for a motor vehicle. The fuel supply system includes a pressure store to which fuel is supplied and a pressure sensor for measuring the pressure in the pressure store. The method includes the steps of: supplying fuel from the pressure store to a combustion in the engine; changing the pressure in the pressure store; detecting behavior of the combustion of the fuel; and, drawing a conclusion as to the operability of the pressure sensor from the detected behavior of the combustion.

The fuel supply system of the invention is for an internal combustion engine such as an engine for a motor vehicle. The fuel supply system includes: fuel supply means for supplying fuel for the engine; a pressure store wherein fuel is held under pressure for metering to the engine; pump means for pumping fuel to the pressure store and for generating pressure in the pressure store; a control apparatus for controlling variables influencing a combustion of the fuel in the engine; a pressure valve connected between the pump means and the pressure store; a pressure sensor for detecting the pressure of the fuel in the pressure store; means for changing the pressure in the pressure store; means for detecting the behavior of the combustion of the fuel; and, means for checking the pressure sensor based on the detected behavior of the combustion.

The fuel quantity injected into the combustion chamber is changed by the change of the pressure in the pressure store. In this way, a larger fuel quantity is injected, for example, for a higher pressure and otherwise like conditions. The changed injected fuel quantity causes a change of the ratio of the air/fuel mixture in the combustion chamber. This, in turn, directly effects a change of the behavior of the combustion. Accordingly, with a greater injected fuel quantity, for example, a rich air/fuel mixture is obtained with corresponding results for the combustion such as with respect to generated exhaust gases. This change of behavior of the combustion is detected, for example, with the aid of a lambda sensor subjected to the generated exhaust gases. A conclusion can be drawn as to the function of the pressure sensor in dependence upon this change of the combustion. If, for example, the detected change of the combustion corresponds to an expected change, which would be expected because of the change of pressure measured with the aid of the pressure sensor, then a conclusion can be drawn therefrom as to the operability of the pressure sensor.

With the invention, a possibility is therefore achieved with which the pressure sensor can be tested as to its operability. For carrying out this test, no special components are required; instead, it is sufficient to correspondingly drive and measure the already available components. When using a computer-supported control apparatus, the method of the invention can be realized via a corresponding program.

With the aid of the test according to the invention, it is possible to already detect slight measuring inaccuracies of the pressure sensor based on changes of the combustion resulting therefrom. A defect of the pressure sensor can be clearly detected rapidly and reliably with the aid of the test. In this respect, the invention defines a significant improvement of the engine with respect to a uniformly precise function of the used components.

In an advantageous embodiment of the invention, a change of the behavior of the combustion from a first state into a second state is expected with a change of the pressure from a first value to a second value. The change of the pressure is measured by the pressure sensor. The expected change then defines a desired value and can be computed in advance of carrying out the test method of the invention or can be determined in another manner. It is especially purposeful when the expected change of the behavior of the combustion is detected and stored in advance for a non-defective pressure sensor, especially for a new pressure sensor and a new fuel supply system. In this way, it is ensured that the measurement of the pressure by the pressure sensor is correct and that the expected change of the behavior of the combustion thereby precisely corresponds to the particular change which results for an intact pressure sensor.

In an advantageous further embodiment of the invention, the detected change of the behavior of the combustion is compared to the expected change of the behavior of the combustion. This defines a desired/actual value comparison with respect to the change of the behavior of the combustion. If an inequality results with this comparison, then a conclusion is drawn as to a measurement inaccuracy or a defect of the pressure sensor. If, in contrast, the actual value corresponds to the desired value, then the conclusion is drawn that the pressure sensor is not defective.

In further advantageous embodiments of the invention, the pressure in the pressure store is increased and/or the time duration of the supply of the fuel for the combustion is reduced. An increase of the pressure leads to a richer air/fuel mixture and a reduction of the time duration leads to a leaner air/fuel mixture. For otherwise like conditions, both cause a change of the behavior of the combustion which is then detected and applied for checking the pressure sensor. It is understood that the pressure can also be reduced and/or the time duration can be increased.

It is especially purposeful when the pressure increase is carried out simultaneously with the reduction of the time duration or the pressure reduction is carried out simultaneously with the increase of the time duration. In this way, it is possible to compensate the counter-running changes of the behavior of the combustion. No change occurs in the behavior of the combustion for a pressure sensor which correctly measures the pressure increase or pressure reduction. However, if a change is determined, then a conclusion can be drawn therefrom as to a measuring inaccuracy or a defect of the pressure sensor. The above-mentioned compensation affords the significant advantage that the control of the fuel supply system (and therefore especially the generated exhaust gas of the engine) is in this case not affected in any way by the method of the invention. The execution of the test according to the invention does not appear externally.

In an advantageous embodiment of the invention, the behavior of the combustion is detected by the behavior of a lambda control and preferably by an output variable of the lambda control such as a control factor of the lambda control. In this way, the lambda value of the composition of the air/fuel mixture is applied also for the check of the pressure sensor in accordance with the invention. The lambda value is significant for the combustion. A high precision and reliability is thereby ensured with respect to the detection of a measurement inaccuracy or a defect of the pressure sensor.

In another advantageous embodiment of the invention, other variables (which influence the combustion of the fuel) are held constant and/or are inhibited. This, on the one hand, simplifies the test method of the invention and simultaneously ensures a clear and precise check of the pressure sensor.

The realization of the method of the invention is especially significant in the form of an electric store medium which is provided for a control apparatus of an internal combustion engine such as for a motor vehicle. A program is stored in the electric store medium which is especially suitable for running on a computer such as a microprocessor and is suitable for carrying out the method of the invention. In this case, the invention is realized by a program, which is stored on the electric storage medium, so that this storage medium, which is provided with the program, defines the invention in the same manner as the method which can be executed by the program.

In the fuel supply system of the invention, it is especially advantageous when the pump and/or the pressure valve can be correspondingly controlled by the control apparatus to change the pressure in the pressure store. A control of this kind is required also in combination with the metering of the fuel quantity to be injected so that no special control must be generated; instead, the known control can be used.

In an advantageous further embodiment of the invention, a lambda control can be used to detect the behavior of the combustion of the fuel. The lambda control is realized by the control apparatus. This lambda control is usually already available for the control of the fuel quantity to be injected and can therefore be used simultaneously for the method of the invention. A separate detection of the behavior of the combustion of the fuel only for the purpose of the check of the pressure sensor is thereby avoided.

In a further embodiment of the invention, a sequence is realized with the control apparatus with which a conclusion can be drawn as to the operation of the pressure sensor based on the detected behavior of the combustion.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
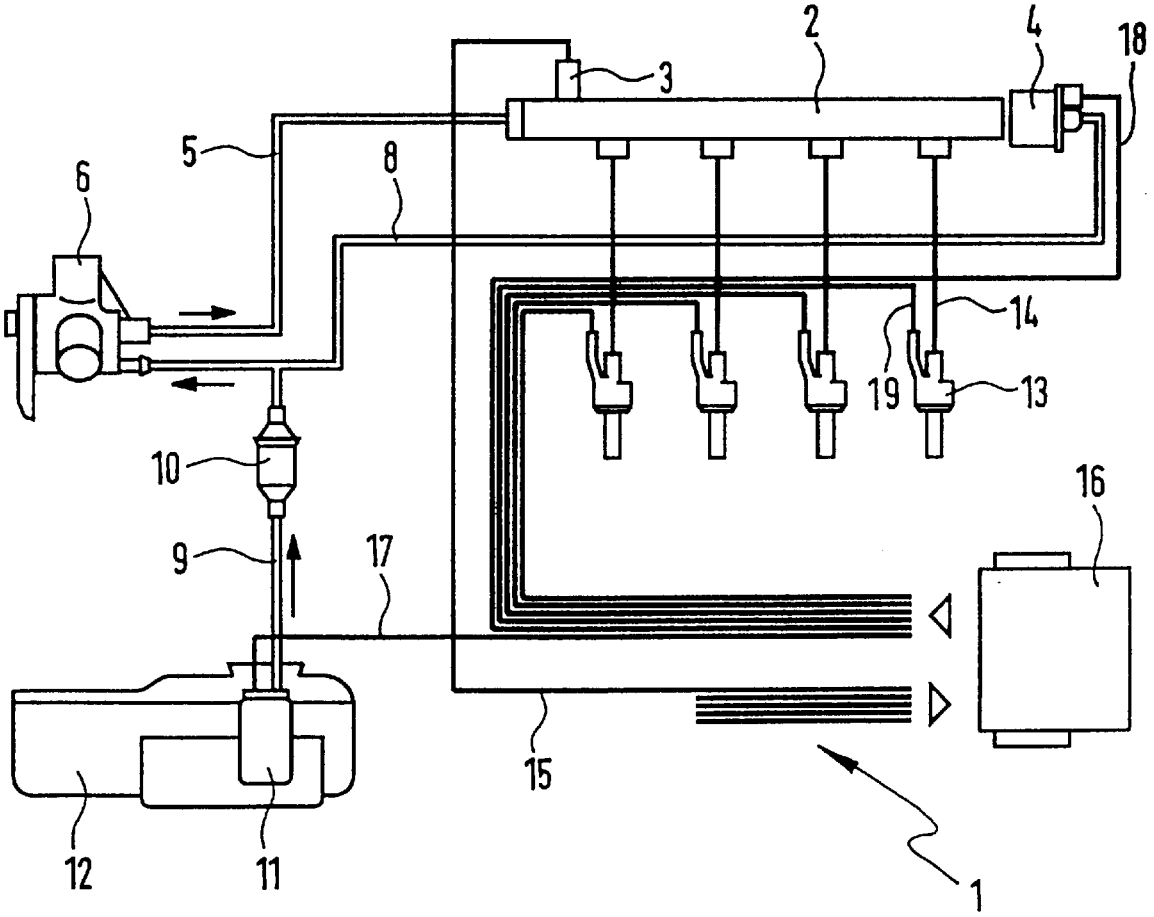
FIG. 1 shows a schematic of a fuel supply system according to an embodiment of the invention.

In FIG. 1, a fuel supply system 1 is shown which is provided for the use in an internal combustion engine of a motor vehicle. The fuel supply system 1 is a so-called common-rail system which is utilized in an internal combustion engine having direct injection.

The fuel supply system 1 includes a pressure store 2 having a pressure sensor 3 and a pressure valve 4. The pressure store 2 is connected via a pressure line 5 to a high-pressure pump 6. The pump 6 is connected via a pressure line 8 to the pressure valve 4. The pressure valve 4 and therefore the high-pressure pump 6 are connected via a pressure line 9 and a filter 10 to a fuel pump 11 which is suitable to draw fuel via suction from the fuel tank 12.

The fuel supply system 1 includes four injection valves 13 which are connected via pressure lines 14 to the pressure store 2. The injection valves 13 are adapted to inject fuel into a combustion chamber of the engine.

The pressure sensor 3 is connected to the control apparatus 16 via a signal line 15. A plurality of other signal lines is connected as input lines to the control apparatus 16. The fuel pump 11 is connected to the control apparatus 16 via a signal line 17 and the pressure valve 4 is connected via a signal line 18 also to the control apparatus 16. Furthermore, the injection valves 13 are connected via signal lines 19 to the control apparatus 16.

The fuel is pumped by the fuel pump 11 from the fuel tank 12 to the high-pressure pump 6. With the aid of high-pressure pump 6, a pressure is generated in the pressure store 2 which is measured by pressure sensor 3 and can be adjusted to a desired value via a corresponding actuation of the pressure valve 4 and/or control of the fuel pump 11. The fuel is injected into the combustion chamber of the engine via the injection valves 13. There, the combustion of the fuel takes place and the occurring exhaust gases are discharged via the exhaust system. A lambda sensor, which is connected to the control apparatus 16, is mounted in the exhaust system. The composition of the exhaust gas is measured with the aid of this lambda sensor. In dependence upon this measurement, the quantity of fuel to be injected is influenced with the objective of reducing the discharged exhaust gas. This quantity of fuel is influenced by a lambda control of the control apparatus 16.

The pressure in the pressure store 2 is, inter alia, significant for the metering of the fuel quantity injected into the combustion chamber. The greater the pressure in the pressure store 2, the greater the quantity of fuel injected during the same injection time into the combustion chamber. The pressure sensor 3 must therefore always be fully operational; that is, a measuring inaccuracy or even a defect of the pressure sensor 3 must be reliably detectable.

Figure 2:
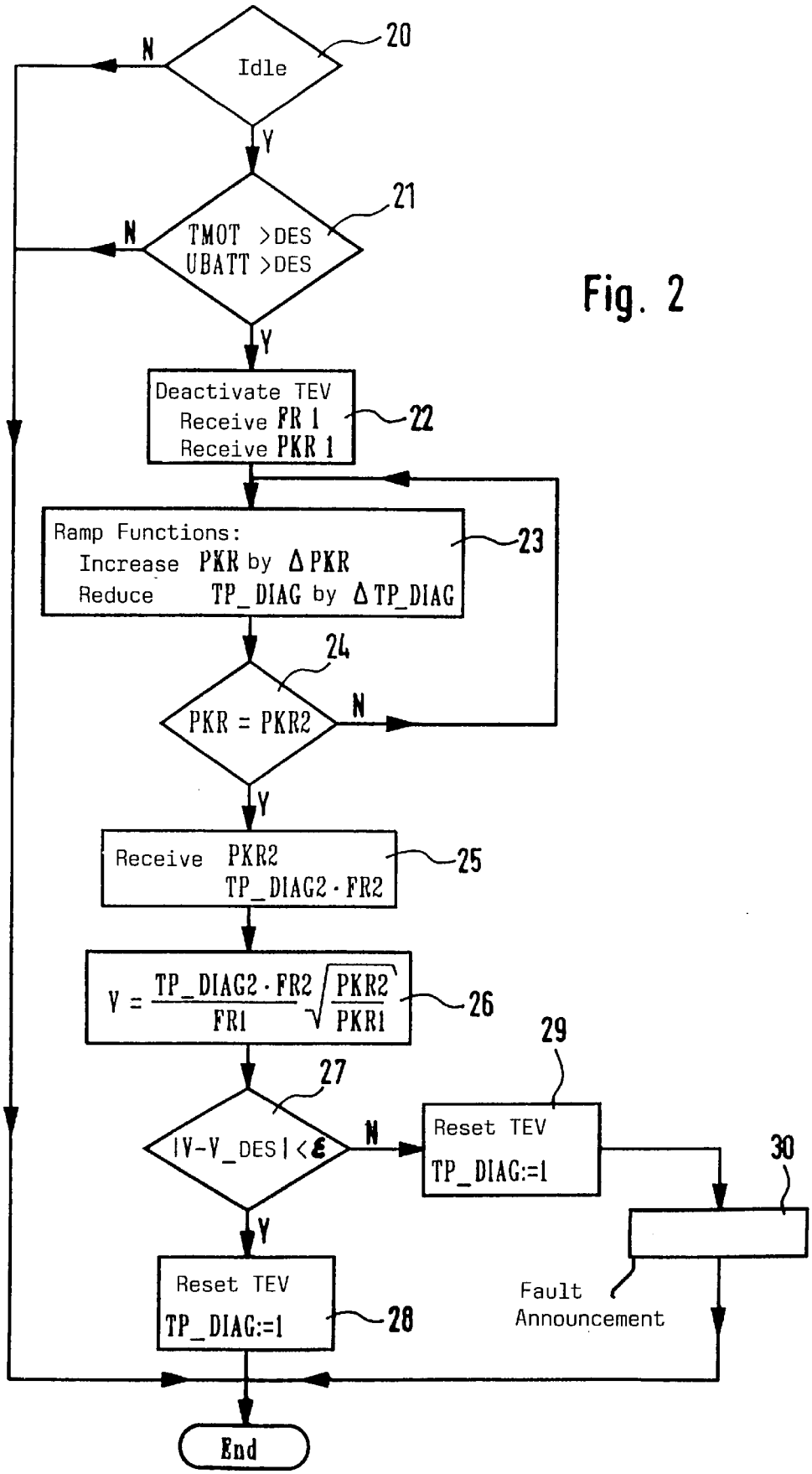
FIG. 2 is a flowchart showing the method according to an embodiment of the invention for checking a pressure sensor of the fuel supply system of FIG. 1.

In FIG. 2, a method for checking the operability of the pressure sensor 3 is shown with which a measurement inaccuracy or a defect of the pressure sensor 3 can be detected. The method shown is carried out by the control apparatus 16 and especially by a correspondingly programmed microprocessor thereof. For storing the method shown in FIG. 2, the control apparatus 16 is provided with an electric memory medium such as a read-only-memory (ROM) or the like.

First, a check is made in two steps 20 and 21 whether the engine is in an essentially constant operating state. For this purpose, a check is made in step 20 as to whether the engine is in idle. If this is not the case, then the method is ended. Otherwise, a check is made in step 21 as to whether the engine temperature TMOT and the battery voltage UBATT are each greater than a corresponding pregiven desired value. If this is not the case, then the method is ended. As further criteria of a constant operating state of the engine, a check can be made as to the following: whether the lambda control is active, whether a constant load is present or the like. Furthermore, monitoring can be performed as to whether load-changing aggregates are switched in by the driver or it can be inhibited that load-changing aggregates are switched in.

If these criteria are satisfied, then a tank-venting valve TEV is closed in step 22 so that a constant operating state of the engine is ensured. Then, in step 22, a first operating state of the engine is taken up. Here, the following are of concern: a first value PKR1 of the pressure in the pressure store 2 and a first state of the behavior of the combustion of the fuel in the combustion chamber of the engine. The first state of the behavior of the combustion is detected with the aid of the lambda control. This is done via a control factor FR of the lambda control. The first value PKR1 and the first state FR1 are stored by the control apparatus 16.

Figure 3:
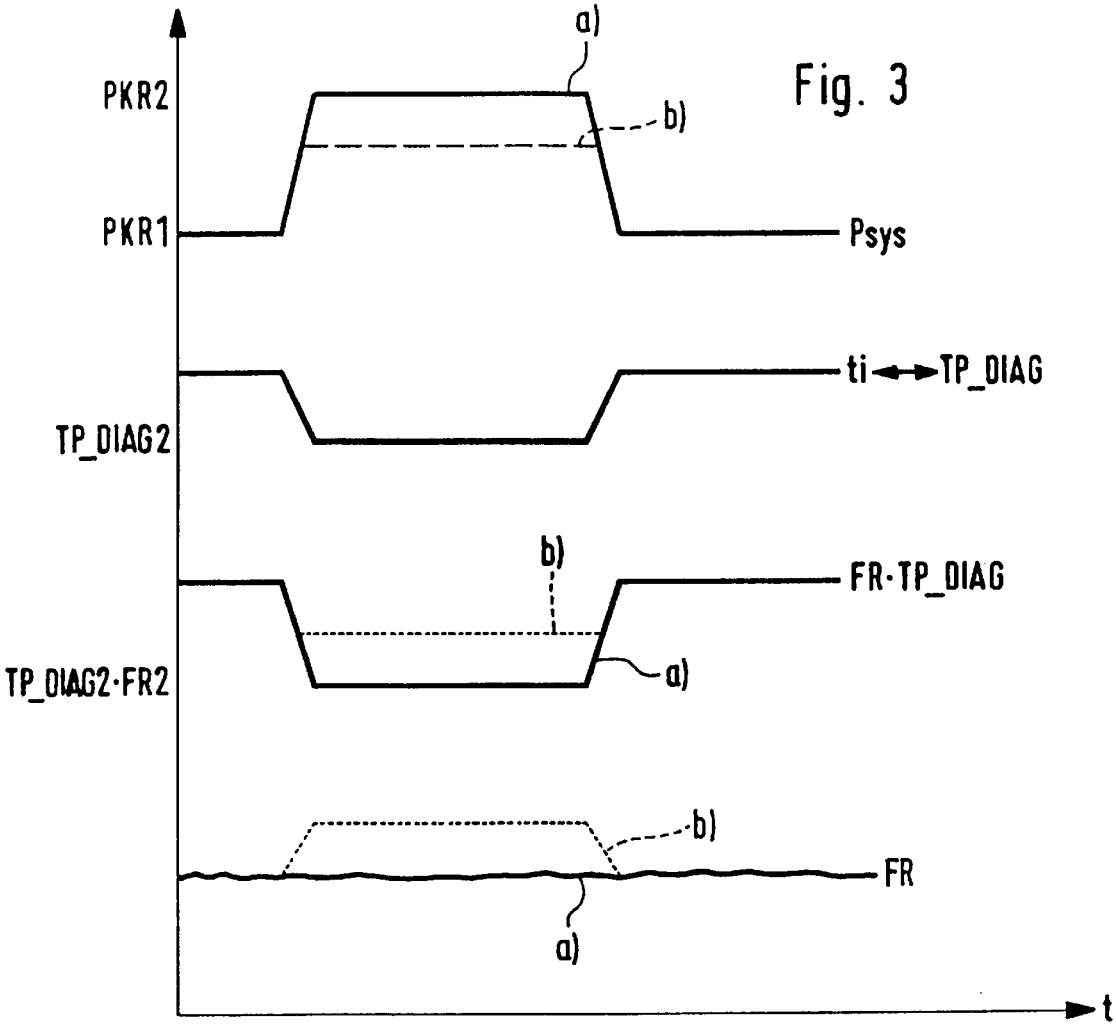
FIG. 3 shows a set of waveforms of signals plotted as a function of time with the signals occurring in the fuel supply system of FIG. 1; and, FIG. 4 shows a set of signals plotted as a function of time with these signals occurring in the fuel supply system for a simplified embodiment of the invention.

By means of two steps 23 and 24, the pressure PKR in the pressure store 2 is increased until the pressure has a second value PKR2. This can be achieved by correspondingly driving the pressure valve 4 and/or the fuel pump 11 by the control apparatus 16. The value of the pressure in the pressure store 2 is measured by the pressure sensor 3. The increase of the pressure in the pressure store 2 takes place, in each case, by ΔPKR values so that, in total, a ramp is generated as shown in FIG. 3 as a signal trace of $p_{sys}$.

At the same time, in steps 23 and 24, a factor TP_DIAG, which influences the injection time, is reduced and, in each case, by ΔTP_DIAG values. This factor is normally 1 and becomes less than 1 by the ΔTP_DIAG values. This causes a ramp-shaped shortening of the injection time as shown in FIG. 3 as a signal trace of $t_i$.

All other parameters, which influence combustion, are not changed. These parameters include, inter alia, the air volume, which flows into the combustion chamber or the like.

If the second value PKR2 of the pressure in the pressure store 2 is reached, then PKR2 is stored in the control apparatus 16 in step 25. Furthermore, the product of the instantaneous value TP_DIAG2 of the factor influencing the injection time and the instantaneous value FR2 of the control factor of the lambda control is computed, that is, TP_DIAG2*FR2. This is shown in FIG. 3 as a corresponding signal trace.

In a following step 26, a value V is computed by the control apparatus 16 in accordance with the equation:

$$V = \frac{TP_DIAG2 \cdot FR2}{FR1}\sqrt{\frac{PKR2}{PKR1}}$$

This equation results from the outflow velocity of the fuel from the pressure store 2 with the aid of the Bernoulli equation. Likewise, it is possible to determine the value V via a model computation or with the aid of measurements on a test stand.

The described steps 20 to 26 are first run through directly after the manufacture of the engine, that is, in a state in which it can be assumed that the components of the engine, and especially the pressure sensor 3, have no defects but are fully operational. Likewise, it is possible that the mentioned steps 20 to 26 are run through only once for each engine type. Furthermore, it can be required that the steps 20 to 26 are run through after an exchange of components of the engine.

Via steps 20 to 26, the ΔPKR values and the ΔTP_DIAG values are so matched to each other and fixedly adjusted that the respective resultant effects mutually compensate. This means that the increase of the pressure in the pressure store 2 is compensated by the shortening of the injection time and, overall, a constant fuel quantity is injected into the combustion chamber. The lambda control must therefore not intervene because of the compensation. The value, which results in this state from the above equation, defines a desired value V_DES which represents an intact engine and especially an intact pressure sensor 3. This desired value V_DES is stored by the control apparatus 16.

During the later operation of the engine, the steps 20 to 26 can be repeated at desired time points, especially at constant intervals. A conclusion can be drawn as to the operability of the pressure sensor 3 from the actual values which occur during operation and especially from the actual values PKR1 and PKR2 measured by the pressure sensor 3.

If the pressure sensor 3 is intact and therefore fully operational, then the actual measured pressure corresponds to the actual pressure in the pressure store 2. This is shown in FIG. 3 by the signal trace (a) (solid line). In this case, (that is, as for the formation of the desired value V_DES), the increase of the pressure is compensated by the shortening of the injection time so that the lambda control does not have to intervene. The control factor FR of the lambda control thereby remains constant as shown with the corresponding signal trace in FIG. 3. The actual value V_ACT resulting from the above equation thereby corresponds to the desired value V_DES so that, in a subsequent 27, a difference of |V_ACT−V_DES| results which is approximately 0 and therefore less than a pregiven $\epsilon$ in each case.

If now, oppositely, a difference is computed by the control apparatus 16 in step 27, which is less than the above-mentioned $\epsilon$, the control apparatus 16 can conclude therefrom that the pressure sensor 3 is intact. The method is then continued with step 28 wherein the tank-venting valve TEV is again activated and the factor TP_DIAG is again set to 1. The method is then ended and the normal operation of the fuel supply system 1 is continued.

If, in contrast, the pressure sensor 3 is defective or exhibits at least a measuring inaccuracy, then this has the consequence that the pressure, which is measured by the pressure sensor 3, does not correspond to the actual pressure in the pressure store 2. This is shown in FIG. 3 with the broken signal line trace (b). In this case, the erroneously measured increase of pressure in the pressure store 2 cannot be compensated by the shortening of the injection time which is pregiven by means of the ΔTP_DIAG values. This has the consequence that the lambda control must intervene in order to control out this error. This takes place via a corresponding change of the control factor of the lambda control as shown in FIG. 3 with the corresponding signal trace. With this intervention by the lambda control, an actual value V_ACT results from the above equation which is different from the desired value V_DES. The difference, which is formed in step 27, is then greater than the pregiven value $\epsilon$.

If now, oppositely, a difference is computed by the control apparatus 16 in step 27, which is greater than the above-mentioned value $\epsilon$, then the control apparatus 16 can draw the conclusion as to the pressure sensor 3 that this sensor is defective or at least exhibits a measuring error. The method is then continued with a step 29 wherein the tank-venting valve TEV is again activated and the factor TP_DIAG is again set to 1. Thereafter, in step 30, a fault announcement is generated by the control apparatus 16 which is outputted to the driver of the motor vehicle and/or to a diagnostic device or the like. Thereafter, the method is ended.

In a simplified embodiment of the method shown in FIG. 2, only the pressure in the pressure store 2 is increased; however, the injection time is not changed. The factor TP_DIAG, which influences the injection time, is therefore not present or continuously 1.

The above has the consequence that the increase of the pressure from the first value PKR1 to the second value PKR2 must be compensated by the lambda control. This takes place in that the control factor of the lambda control drops from a first value FR1 to a second value FR2. This is shown by the corresponding signal traces in FIG. 4.

As already mentioned, a desired value is first determined for an intact pressure sensor, especially for a new pressure sensor 3 and a new fuel supply system 1. This desired value results for the present simplified embodiment from the quotient of FR1 and FR2. As described, the desired value is stored in the control apparatus 16.

In operation of the engine, an actual value of the quotient FR1 and FR2 is computed which, however, is dependent upon the actual values occurring during operation.

Figure 4:
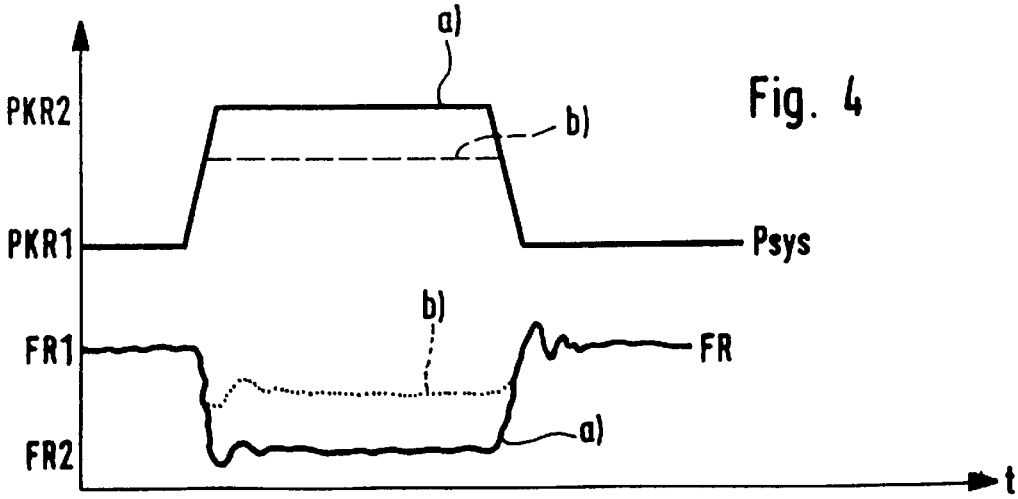

If an actual value of the quotient results which approximately corresponds to the above-mentioned desired value, then the control apparatus 16 can conclude therefrom as to an intact pressure sensor. This case is shown in FIG. 4 with the solid line signal traces (a).

If, in contrast, an actual value of the quotient results which differs from the desired value, then the control apparatus 16 must conclude therefrom that the pressure sensor has measured an incorrect value of the pressure in the pressure store 2. The pressure sensor 3 is therefore defective or at least exhibits a measuring inaccuracy. This case is shown in FIG. 4 with the broken-line signal traces (b).

It is understood that the foregoing description is that of the preferred embodiments of the invention and that various changes and modifications may be made thereto without departing from the spirit and scope of the invention as defined in the appended claims.

What is claimed is:

1. A method of checking a pressure sensor of a fuel supply system of an internal combustion engine, the fuel supply system including a pressure store to which fuel is supplied and a pressure sensor for measuring the pressure in the pressure store, the method comprising the steps of:

supplying fuel from said pressure store to a combustion in said engine;

changing the pressure in said pressure store;

detecting behavior of the combustion of said fuel; and, drawing a conclusion as to the operability of said pressure sensor from the detected behavior of said combustion.

2. The method of claim 1, wherein a change of the behavior of said combustion is expected for a change of said pressure from a first value (PKR1) to a second value (PKR2).

3. The method of claim 2, wherein, for a non-defective pressure sensor, the expected change of the behavior of the combustion (V_DES) is initially detected and stored.

4. The method of claim 3, further comprising the step of comparing the detected change of behavior of the combustion (V_ACT) to said expected change of the behavior of said combustion (V_DES).

5. The method of claim 4, further comprising the step of drawing a conclusion as to a defect of said pressure sensor when there is an inequality.

6. The method of claim 1, further comprising the step of increasing said pressure in said pressure store.

7. The method of claim 1, further comprising the step of reducing the time duration of supplying fuel for said combustion.

8. The method of claim 1, further comprising the steps of increasing said pressure in said pressure store and simultaneously reducing the time duration of supplying fuel for said combustion.

9. The method of claim 1, further comprising the step of detecting the behavior of said combustion via the performance of a lambda control.

10. The method of claim 9, further comprising the step of detecting an output quantity of said lambda control.

11. The method of claim 10, wherein said output quantity is a control factor (FR).

12. The method of claim 1, wherein other variables which influence the combustion of said fuel are held constant and/or are rendered ineffective.

13. The method of claim 1, wherein said internal combustion engine is an engine for a motor vehicle.

14. The method of claim 3, wherein said pressure sensor is a new pressure sensor and said fuel supply system is a new fuel supply system.

15. An electric storage medium for a control apparatus of an internal combustion engine, said electric storage medium comprising means for storing a program which can be run on a control apparatus and said program functioning to execute a method including the steps of:

supplying fuel from a pressure store to a combustion in said engine;

changing the pressure in said pressure store;

detecting behavior of the combustion of said fuel; and, drawing a conclusion as to the operability of said pressure sensor from the detected behavior of said combustion.

16. The electric storage medium of claim 15, wherein said electric storage medium is a read-only memory and said internal combustion engine is an internal combustion engine of a motor vehicle.

17. A fuel supply system for an internal combustion engine, the fuel supply system comprising:

fuel supply means for supplying fuel for said engine;

a pressure store wherein fuel is held under pressure for metering to said engine;

pump means for pumping fuel to said pressure store and for generating pressure in said pressure store;

a control apparatus for controlling variables influencing a combustion of said fuel in said engine;

a pressure valve connected between said pump means and said pressure store;

a pressure sensor for detecting the pressure of said fuel in said pressure store;

means for changing said pressure in said pressure store;

means for detecting the behavior of said combustion of said fuel; and, means for checking said pressure sensor based on the detected behavior of said combustion.

18. The method of claim 17, wherein said internal combustion engine is an engine for a motor vehicle.

19. The fuel supply system of claim 17, wherein said control apparatus functions to control at least one of said pump means and said pressure valve to change the pressure in said pressure store.

20. The fuel supply system of claim 17, wherein said control apparatus functions to realize a lambda control for detecting said behavior of said combustion of said fuel.

21. The fuel supply system of claim 17, wherein said control apparatus functions to realize a sequence with which a conclusion is drawn as to the operability of said pressure sensor based on the detected behavior of said combustion.

* * * * *

UNITED STATES PATENT AND TRADEMARK OFFICE

CERTIFICATE OF CORRECTION

PATENT NO. : 6,012,438
DATED : January 11, 2000
INVENTOR(S) : Klaus Joos, et. al.

It is certified that error appears in the above-identified patent and that said Letters Patent is hereby corrected as shown below:

On the title page, under "Assignee": delete "Stuggart" and substitute -- Stuttgart -- therefor.

In column 7, line 9: between "subsequent" and "27", insert -- step --.

In column 10, line 11: delete "method" and substitute -- fuel supply system -- therefor.

Signed and Sealed this

Eighth Day of May, 2001

*Attest:*

Nicholas P. Godici

NICHOLAS P. GODICI

*Attesting Officer*

*Acting Director of the United States Patent and Trademark Office*